US008641462B2

(12) United States Patent
Kuriyagawa

(10) Patent No.: US 8,641,462 B2
(45) Date of Patent: Feb. 4, 2014

(54) OUTBOARD MOTOR CONTROL APPARATUS

(75) Inventor: Koji Kuriyagawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 196 days.

(21) Appl. No.: 13/115,255

(22) Filed: May 25, 2011

(65) Prior Publication Data

US 2011/0294373 A1 Dec. 1, 2011

(30) Foreign Application Priority Data

May 28, 2010 (JP) ..... 2010-123289

(51) Int. Cl.
*B63H 21/22* (2006.01)
*B63H 23/00* (2006.01)

(52) U.S. Cl.
USPC ..... 440/1

(58) Field of Classification Search
USPC ..... 440/1, 49, 75, 80, 81, 84, 86, 87
See application file for complete search history.

(56) References Cited

U.S. PATENT DOCUMENTS

| | | | | |
|---|---|---|---|---|
| 5,142,473 | A * | 8/1992 | Davis | 701/21 |
| 7,238,071 | B2 * | 7/2007 | Takada et al. | 440/84 |
| 7,243,009 | B2 * | 7/2007 | Kaji | 701/21 |
| 7,762,859 | B2 | 7/2010 | Suzuki et al. | |
| 7,909,670 | B2 | 3/2011 | Suzuki et al. | |
| 8,066,539 | B2 | 11/2011 | Suzuki et al. | |

FOREIGN PATENT DOCUMENTS

| | | | |
|---|---|---|---|
| JP | 2001-336630 | A | 12/2001 |
| JP | 2007-170610 | A | 7/2007 |
| JP | 2009-190671 | A | 8/2009 |
| JP | 2009-190672 | A | 8/2009 |
| JP | 2009-196515 | A | 9/2009 |
| JP | 2010-107049 | A | 5/2010 |

OTHER PUBLICATIONS

JP Office Action issued on Jul. 24, 2013 in the corresponding JP application with English translation thereof.

* cited by examiner

*Primary Examiner* — Daniel V Venne
(74) *Attorney, Agent, or Firm* — Carrier Blackman & Associates, P.C.; William D. Blackman; Anne G. Sabourin

(57) ABSTRACT

In an apparatus for controlling operation of an outboard motor having an internal combustion engine and a transmission selectively changeable in gear position to establish speeds including a first speed and a second speed and transmitting power of the engine to the propeller with a gear ratio determined by established speed, it is configured to control operation of the transmission to change the gear position to the first or second speed in response to an outputted speed change command, determine whether an engine speed is continuously equal to or greater than a predetermined speed for a predetermined time period when the speed change command to the first speed is outputted, and when the determination is affirmative, change the gear position from the first speed to the second speed. With this, it becomes possible to mitigate the load on a transmission gear to improve durability of the transmission.

8 Claims, 10 Drawing Sheets

OUTBOARD MOTOR CONTROL APPARATUS

BACKGROUND OF THE INVENTION

1. Technical Field

This invention relates to an outboard motor control apparatus, particularly to an apparatus for controlling an outboard motor with a transmission.

2. Background Art

In recent years, there is proposed a technique for an outboard motor having a transmission interposed at a power transmission shaft between an internal combustion engine and a propeller to change an output of the engine in speed and transmit it to the propeller, as taught, for example, by Japanese Laid-Open Patent Application No. 2009-190672. In the reference, a gear position (ratio) of the transmission is changed to the first or second speed in response to a speed change command inputted by the operator.

SUMMARY OF INVENTION

However, since a technique in the reference is configured as above, the engine is operated at relatively high speed when the speed change command to the first speed is outputted upon manipulation by the operator and if this condition continues for a long time, a transmission gear becomes overloaded and it may degrade durability of the transmission disadvantageously.

An object of this invention is therefore to overcome the foregoing problem by providing an apparatus for controlling an outboard motor having a transmission, which apparatus can prevent the engine from being operated at high speed continuously for a long time when a speed change command to the first speed is outputted, thereby mitigating the load on a transmission gear to improve durability of the transmission.

In order to achieve the object, this invention provides in the first aspect an apparatus for controlling operation of an outboard motor adapted to be mounted on a stern of a boat and having an internal combustion engine to power a propeller through a drive shaft and a propeller shaft, and a transmission that is installed at a location between the drive shaft and the propeller shaft, the transmission being selectively changeable in gear position to establish speeds including at least a first speed and a second speed and transmitting power of the engine to the propeller with a gear ratio determined by established speed, comprising: a speed change command outputter adapted to output a speed change command upon manipulation by an operator; a transmission controller adapted to control operation of the transmission to change the gear position to the first speed or the second speed in response to the outputted speed change command; and an engine speed determiner adapted to determine whether a speed of the engine is continuously equal to or greater than a predetermined speed for a predetermined time period when the speed change command to the first speed is outputted, and the transmission controller changes the gear position from the first speed to the second speed when the speed of the engine is determined to be continuously equal to or greater than the predetermined speed for the predetermined time period.

In order to achieve the object, this invention provides in the second aspect a method for controlling operation of an outboard motor adapted to be mounted on a stern of a boat and having an internal combustion engine to power a propeller through a drive shaft and a propeller shaft, and a transmission that is installed at a location between the drive shaft and the propeller shaft, the transmission being selectively changeable in gear position to establish speeds including at least a first speed and a second speed and transmitting power of the engine to the propeller with a gear ratio determined by established speed, comprising the steps of: outputting a speed change command upon manipulation by an operator; controlling operation of the transmission to change the gear position to the first speed or the second speed in response to the outputted speed change command; and determining whether a speed of the engine is continuously equal to or greater than a predetermined speed for a predetermined time period when the speed change command to change the gear position to the first speed is outputted, and the step of controlling changes the gear position from the first speed to the second speed when the speed of the engine is determined to be continuously equal to or greater than the predetermined speed for the predetermined time period

BRIEF DESCRIPTION OF DRAWINGS

The above and other objects and advantages of the invention will be more apparent from the following description and drawings in which.

DESCRIPTION OF EMBODIMENT

An embodiment of an outboard motor control apparatus according to the invention will now be explained with reference to the attached drawings.

Figure 1:
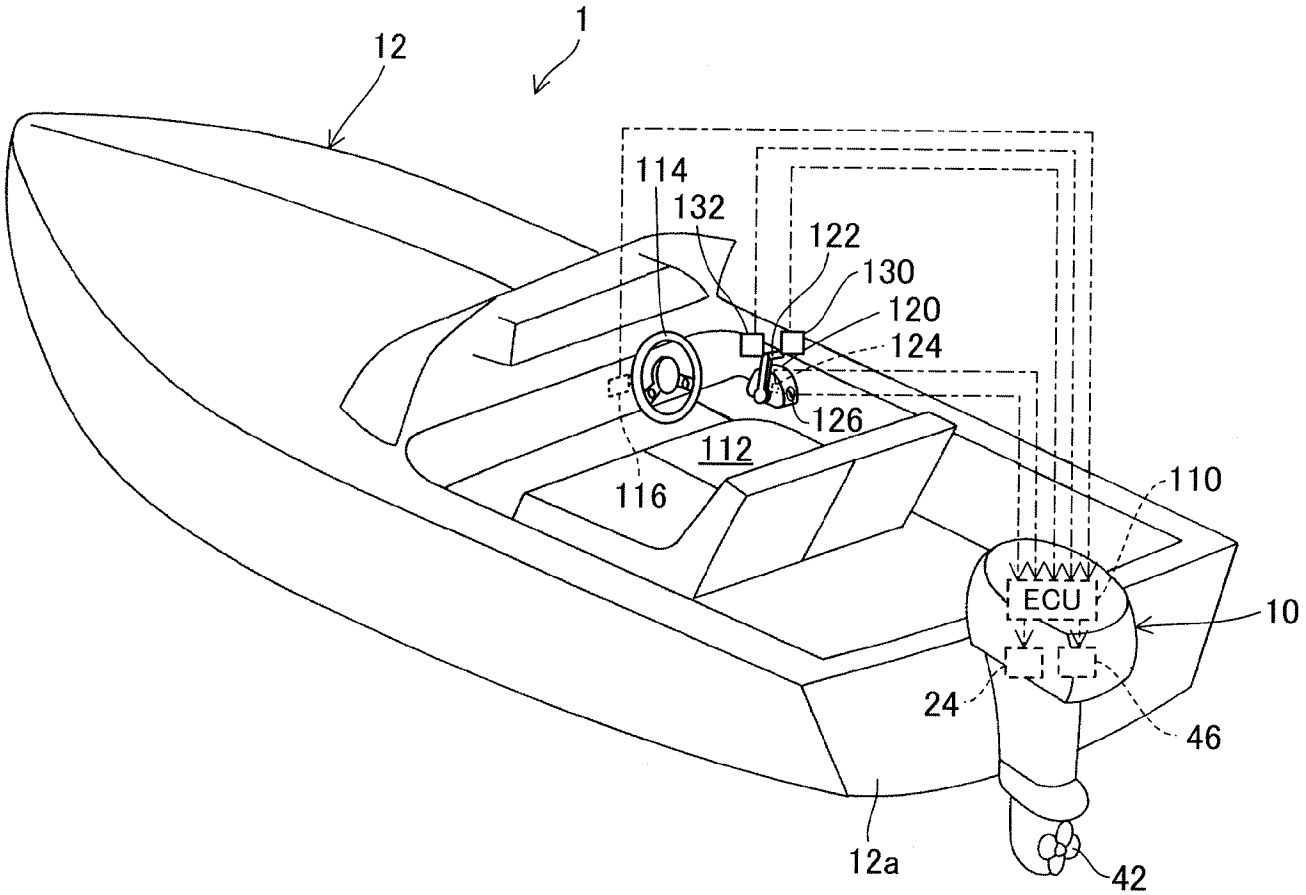
FIG. 1 is an overall schematic view of an outboard motor control apparatus including a boat according to an embodiment of the invention.
Figure 2:
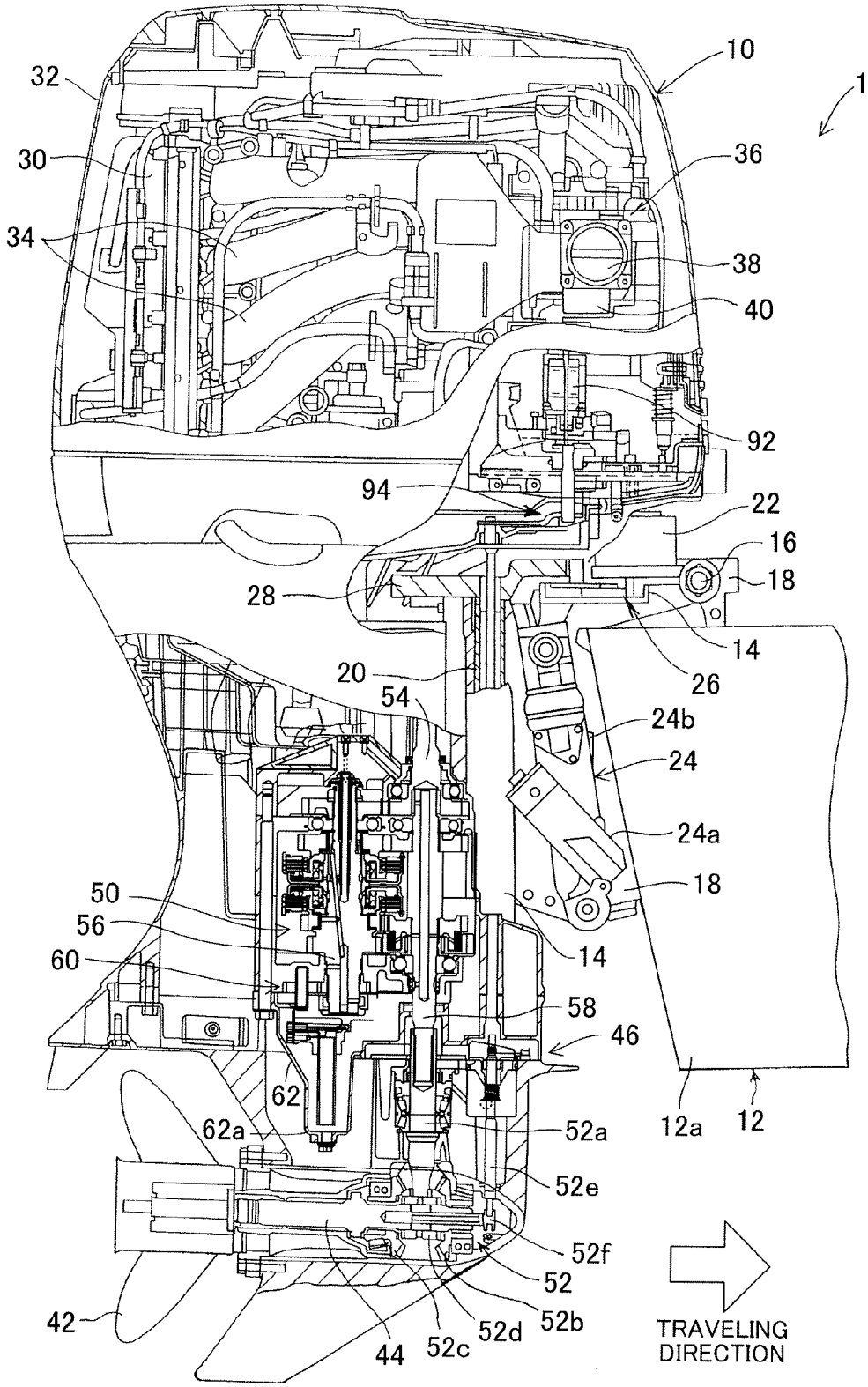
FIG. 2 is an enlarged sectional side view partially showing the outboard motor shown in FIG. 1.

FIG. 1 is an overall schematic view of an outboard motor control apparatus including a boat according to an embodiment of the invention. FIG. 2 is an enlarged sectional side view partially showing the outboard motor shown in FIG. 1 and FIG. 3 is an enlarged side view of the outboard motor.

Figure 3:
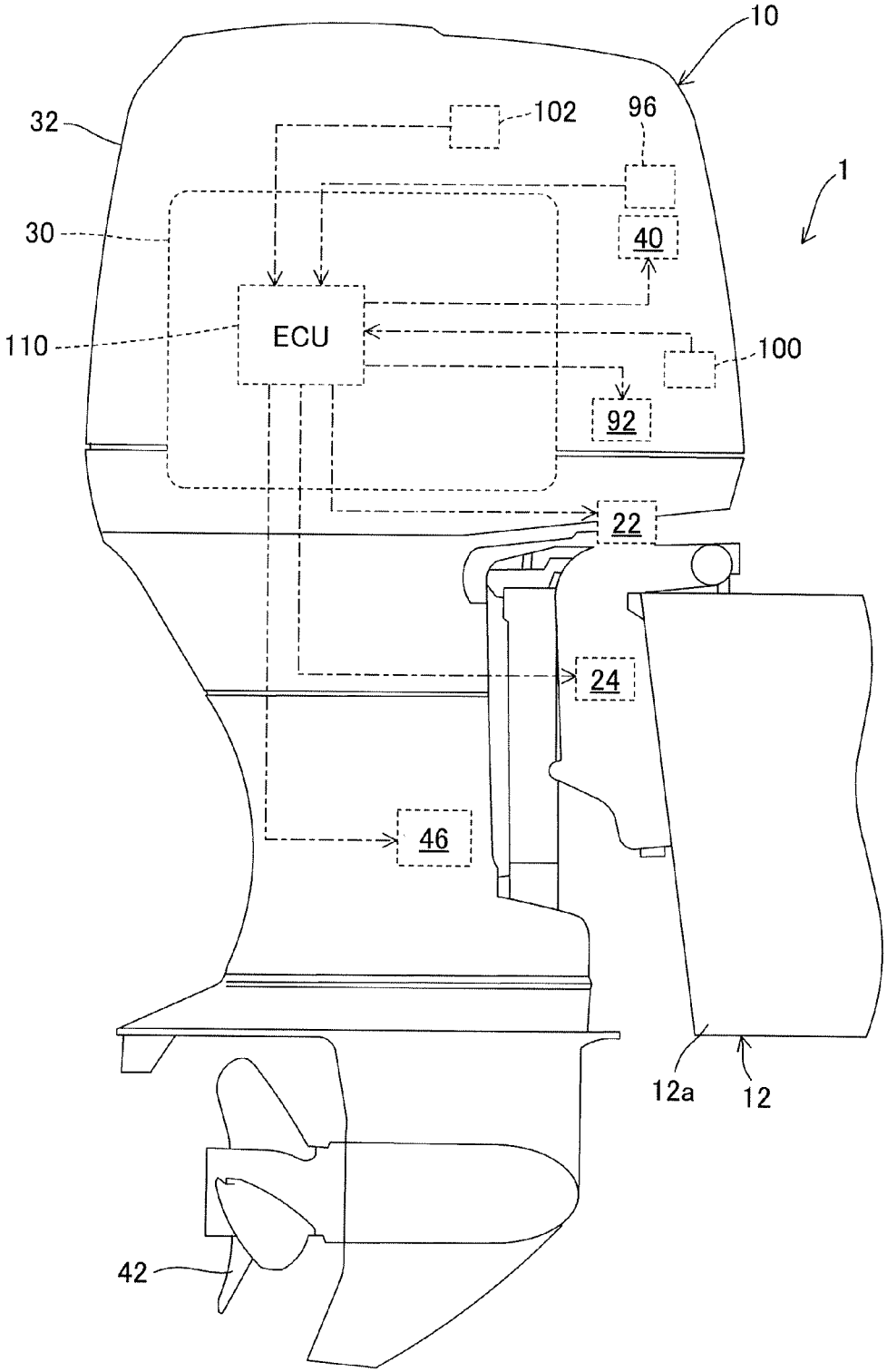
FIG. 3 is an enlarged side view of the outboard motor shown in FIG. 1.

In FIGS. 1 to 3, a symbol 1 indicates a boat or vessel whose hull 12 is mounted with the outboard motor 10. As clearly shown in FIG. 2, the outboard motor 10 is clamped (fastened) to the stern or transom 12*a* of the boat 1, more precisely, to the stern 12*a* of the hull 12 through a swivel case 14, tilting shaft 16 and stern brackets 18.

An electric steering motor (actuator) 22 for operating a shaft 20 which is housed in the swivel case 14 to be rotatable about the vertical axis and a power tilt-trim unit (actuator; hereinafter called the "trim unit") 24 for regulating a tilt angle and trim angle of the outboard motor 10 relative to the boat 1

(i.e., hull 12) by tilting up/down and trimming up/down are installed near the swivel case 14. A rotational output of the steering motor 22 is transmitted to the shaft 20 via a speed reduction gear mechanism 26 and mount frame 28, whereby the outboard motor 10 is steered about the shaft 20 as a steering axis to the right and left directions (steered about the vertical axis).

The trim unit 24 integrally comprises a hydraulic cylinder 24*a* for adjusting the tilt angle and a hydraulic cylinder 24*b* for adjusting the trim angle. In the trim unit 24, the hydraulic cylinders 24*a*, 24*b* are extended/contracted so that the swivel case 14 is rotated about the tilting shaft 16 as a rotational axis, thereby tiling up/down and trimming up/down the outboard motor 10. The hydraulic cylinders 24*a*, 24*b* are connected to a hydraulic circuit (not shown) in the outboard motor 10 and extended/contracted upon being supplied with operating oil therethrough.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control a speed of the engine 30 (engine speed).

The outboard motor 10 further comprises a propeller shaft (power transmission shaft) 44 that is supported to be rotatable about the horizontal axis and attached with a propeller 42 at its one end to transmit power output of the engine 30 thereto, and a transmission 46 that is interposed at a location between the engine 30 and propeller shaft 44 and has a plurality of gear positions, i.e., first, second and third speeds.

The transmission 46 comprises a transmission mechanism 50 that is selectively changeable in gear positions and a shift mechanism 52 that can change a shift position among forward, reverse and neutral positions.

Figure 4:
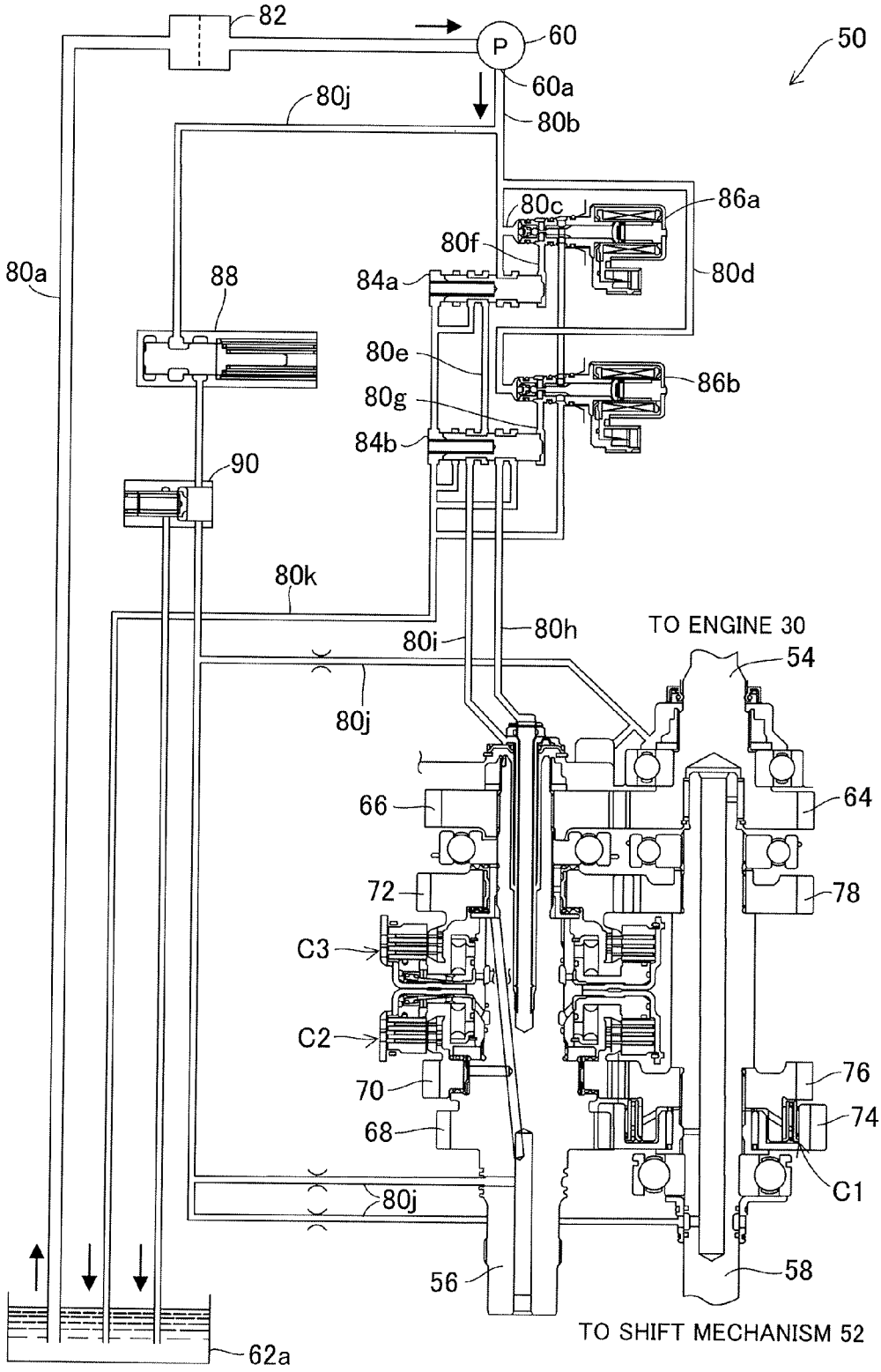
FIG. 4 is a hydraulic circuit diagram schematically showing a hydraulic circuit of a transmission mechanism shown in FIG. 2.

FIG. 4 is a hydraulic circuit diagram schematically showing a hydraulic circuit of the transmission mechanism 50.

As shown in FIGS. 2 and 4, the transmission mechanism 50 comprises a parallel-axis type transmission mechanism with distinct gear positions (ratios), which includes an input shaft (drive shaft) 54 connected to the crankshaft (not shown in the figures) of the engine 30, a countershaft 56 connected to the input shaft 54 through a transmission gear, and a first connecting shaft 58 connected to the countershaft 56 through several transmission gears. Those shafts 54, 56, 58 are installed in parallel.

The countershaft 56 is connected with a hydraulic pump (gear pump; shown in FIGS. 2 and 4) 60 that pumps up the operating oil (lubricating oil) and forwards it to transmission clutches and lubricated portions of the transmission mechanism 50 (explained later). The foregoing shafts 54, 56, 58, hydraulic pump 60 and the like are housed in a case 62 (shown only in FIG. 2). An oil pan 62*a* for receiving the operating oil is formed at the bottom of the case 62.

In the so-configured transmission mechanism 50, the gear installed on the shaft to be rotatable relative thereto is fixed on the shaft through the transmission clutch so that the transmission 46 is selectively changeable in the gear position to establish one of the three speeds (i.e., first to third speeds), and the output of the engine 30 is changed with the gear ratio determined by the established (selected) gear position (speed; gear) and transmitted to the propeller 42 through the shift mechanism 52 and propeller shaft 44. A gear ratio of the gear position (speed) is set to be the highest in the first speed and decreases as the speed changes to second and then third speed.

The further explanation on the transmission mechanism 50 will be made. As clearly shown in FIG. 4, the input shaft 54 is supported with an input primary gear 64. The countershaft 56 is supported with a counter primary gear 66 to be meshed with the input primary gear 64, and also supported with a counter first-speed gear 68, counter second-speed gear 70 and counter third-speed gear 72.

The first connecting shaft 58 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the first connecting shaft 58 is brought into a connection with the first connecting shaft 58 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed (gear position) is established and the rotational speed of the first connecting shaft 58 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 56 is brought into a connection with the countershaft 56 through the second-speed hydraulic clutch (transmission clutch) C2, the second speed (gear position) is established. Further, when the counter third-speed gear 72 supported to be rotatable relative to the countershaft 56 is brought into a connection with the countershaft 56 through the third-speed hydraulic clutch (transmission clutch) C3, the third speed (gear position) is established. The hydraulic clutches C2, C3 connect the gears 70, 72 to the countershaft 56 upon being supplied with the hydraulic pressure, while making the gears 70, 72 rotate idly when the hydraulic pressure is not supplied.

Thus the interconnections between the gears and shafts through the clutches C1, C2, C3 are performed by controlling hydraulic pressure supplied from the pump 60 to the hydraulic clutches C2, C3.

The further explanation will be made. When the oil pump 60 is driven by the engine 30, it pumps up the operating oil in the oil pan 62*a* to be drawn through an oil passage 80*a* and strainer 82 and forwards it from a discharge port 60*a* to a first switching valve 84*a* through an oil passage 80*b* and to first and second electromagnetic solenoid valves (linear solenoid valves) 86*a*, 86*b* through oil passages 80*c*, 80*d*.

The first switching valve 84*a* is connected to a second switching valve 84*b* through an oil passage 80*e*. Each of the valves 84*a*, 84*b* has a movable spool installed therein and the spool is urged by a spring at its one end (left end in the drawing) toward the other end. The valves 84*a*, 84*b* are connected on the sides of the other ends of the spools with the first and second solenoid valves 86*a*, 86*b* through oil passages 80*f*, 80*g*, respectively.

Upon being supplied with current (i.e., made ON), a spool housed in the first solenoid valve 86*a* is displaced to output the hydraulic pressure supplied from the pump 60 through the oil passage 80*c* to the other end side of the spool of the first switching valve 84*a*. Accordingly, the spool of the first switching valve 84*a* is displaced to its one end side, thereby forwarding the operating oil in the oil passage 80*b* to the oil passage 80*e*.

Similarly to the first solenoid valve 86*a*, upon being supplied with current (i.e., made ON), a spool of the second solenoid valve 86*b* is displaced to output the hydraulic pressure supplied from the pump 60 through the oil passage 80*d* to the other end side of the spool of the second switching valve 84*b*. Accordingly, the spool of the second switching valve 84*b* is displaced to its one end side, thereby forwarding the operating oil in the oil passage 80*e* to the second-speed hydraulic clutch C2 through the oil passage 80*h*. In contrast, when the second solenoid valve 86*b* is not supplied with current (made OFF) and no hydraulic pressure is outputted to the other end side of the second switching valve 84*b*, the operating oil in the oil passage 80*e* is forwarded to the third-speed hydraulic clutch C3 through the oil passage 80*i*.

When the first and second solenoid valves 86*a*, 86*b* are both made OFF, the hydraulic pressure is not supplied to the hydraulic clutches C2, C3 and hence, the output first-speed gear 74 and first connecting shaft 58 are interconnected through the first-speed clutch C1 so that the first speed is established.

When the first and second solenoid valves 86*a*, 86*b* are both made ON, the hydraulic pressure is supplied to the second-speed hydraulic clutch C2 and accordingly, the counter second-speed gear 70 and countershaft 56 are interconnected so that the second speed is established. Further, when the first solenoid valve 86*a* is made ON and the second solenoid valve 86*b* is made OFF, the hydraulic pressure is supplied to the third-speed hydraulic clutch C3 and accordingly, the counter third-speed gear 72 and countershaft 56 are interconnected so that the third speed is established.

Thus, one of the gear positions of the transmission 46 is selected (i.e., transmission control is conducted) by controlling ON/OFF of the first and second switching valves 84*a*, 84*b*.

Note that the operating oil (lubricating oil) from the hydraulic pump 60 is also supplied to the lubricated portions (e.g., the shafts 54, 56, 58, etc.) of the transmission 46 through the oil passage 80*b*, an oil passage 80*j*, a regulator valve 88 and a relief valve 90. Also, the first and second switching valves 84*a*, 84*b* and the first and second solenoid valves 86*a*, 86*b* are connected with an oil passage 80*k* adapted to relieve pressure.

The explanation on FIG. 2 is resumed. The shift mechanism 52 comprises a second connecting shaft 52*a* that is connected to the first connecting shaft 58 of the transmission mechanism 50 and installed parallel to the vertical axis to be rotatably supported, a forward bevel gear 52*b* and reverse bevel gear 52*c* that are connected to the second connecting shaft 52*a* to be rotated, a clutch 52*d* that can engage the propeller shaft 44 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among forward, reverse and neutral positions.

When the shift position is the forward or reverse position, the rotational output of the first connecting shaft 58 is transmitted via the shift mechanism 52 to the propeller shaft 44 to rotate the propeller 42 to generate the thrust in one of the directions making the boat 1 move forward or backward. The outboard motor 10 is equipped with a power source (not shown) such as a battery or the like attached to the engine 30 to supply operating power to the motors 22, 40, 92, etc.

As shown in FIG. 3, a throttle opening sensor 96 is installed near the throttle valve 38 and produces an output or signal indicative of opening of the throttle valve 38, i.e., throttle opening TH. A neutral switch 100 is installed near the shift rod 52*e* and produces an ON signal when the shift position of the transmission 46 is neutral and an OFF signal when it is forward or reverse. A crank angle sensor 102 is installed near the crankshaft of the engine 30 and produces a pulse signal at every predetermined crank angle.

The outputs of the foregoing sensor and switch are sent to an Electronic Control Unit (ECU) 110 disposed in the outboard motor 10. The ECU 110 comprises a microcomputer having a CPU, ROM, RAM and other devices and is installed in the engine cover 32 of the outboard motor 10. Among the sensor outputs, the ECU 110 counts the output pulses of the crank angle sensor 102 to detect or calculate the engine speed NE.

As shown in FIG. 1, a steering wheel 114 is installed near a cockpit (the operator's seat) 112 of the hull 12 to be manipulated by the operator (not shown). A steering angle sensor 116 attached on a shaft (not shown) of the steering wheel 114 produces an output or signal corresponding to the steering angle applied or inputted by the operator through the steering wheel 114.

A remote control box 120 provided near the cockpit 112 is equipped with a shift/throttle lever 122 installed to be manipulated by the operator. The lever 122 can be moved or swung in the front-back direction from the initial position and is used by the operator to input a forward/reverse change command and an engine speed regulation command A lever position sensor 124 is installed in the remote control box 120 and produces an output or signal corresponding to a position of the lever 122.

Figure 5:
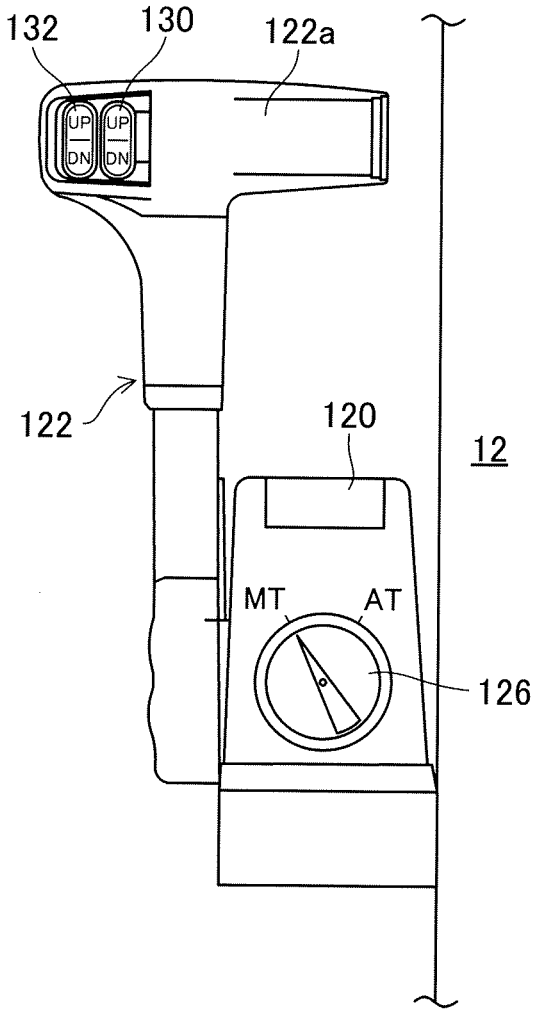
FIG. 5 is an enlarged side view of a remote control box and shift/throttle lever shown in FIG. 1 when viewed from the rear of the boat.

FIG. 5 is an enlarged side view of the remote control box 120 and lever 122 shown in FIG. 1 when viewed from the rear of the boat 1.

As shown in FIG. 5, a change switch 126 is installed in the remote control box 120 to be manipulated by the operator. The change switch 126 is manipulated to select one of a manual speed change mode ("MT" in FIG. 5) and automatic speed change mode ("AT") and produces an output or signal indicative of a selected mode. When the manual speed change mode is selected, transmission control of the transmission 46 is conducted in response to a speed change command inputted by the operator (explained later) and when the automatic speed change mode is selected, the transmission control is conducted based on the engine speed NE, lever 122 position, etc.

The lever 122 is equipped with a grip 122*a* to be gripped or held by the operator and the grip 122*a* is provided with a power tilt-trim switch (hereinafter called the "trim switch") 130 and shift switch (speed change command outputter) 132. The switches 130, 132 are installed to be manipulated by the operator.

The trim switch 130 comprises pushing type switches including an up switch ("UP" in FIG. 5) and a down switch ("DN"). When the up switch is pressed by the operator, the trim switch 130 produces an output or signal indicative of a tilt-up/trim-up command, while when the down switch is pressed, producing an output or signal indicative of a tilt-down/trim-down command.

Similarly, the shift switch 132 comprises pushing type switches including an up switch ("UP" in FIG. 5) and a down switch ("DN") and produces an output or signal indicative of a shift-up command (speed change command) when the up switch is pressed by the operator, while producing that indicative of a shift-down command (speed change command) when the down switch is pressed. Thus the switch 132 outputs the speed change command in response to the manipulation by the operator. The outputs of the sensors 116, 124 and switches 126, 130, 132 are also sent to the ECU 110.

Based on the inputted outputs, the ECU 110 controls the operation of the motors 22, 40, 92 and trim unit 24, while performing the transmission control of the transmission 46. Thus, the outboard motor control apparatus according to the embodiment is a Drive-By-Wire type apparatus whose operation system (steering wheel 114, lever 122) has no mechanical connection with the outboard motor 10.

Figure 6:
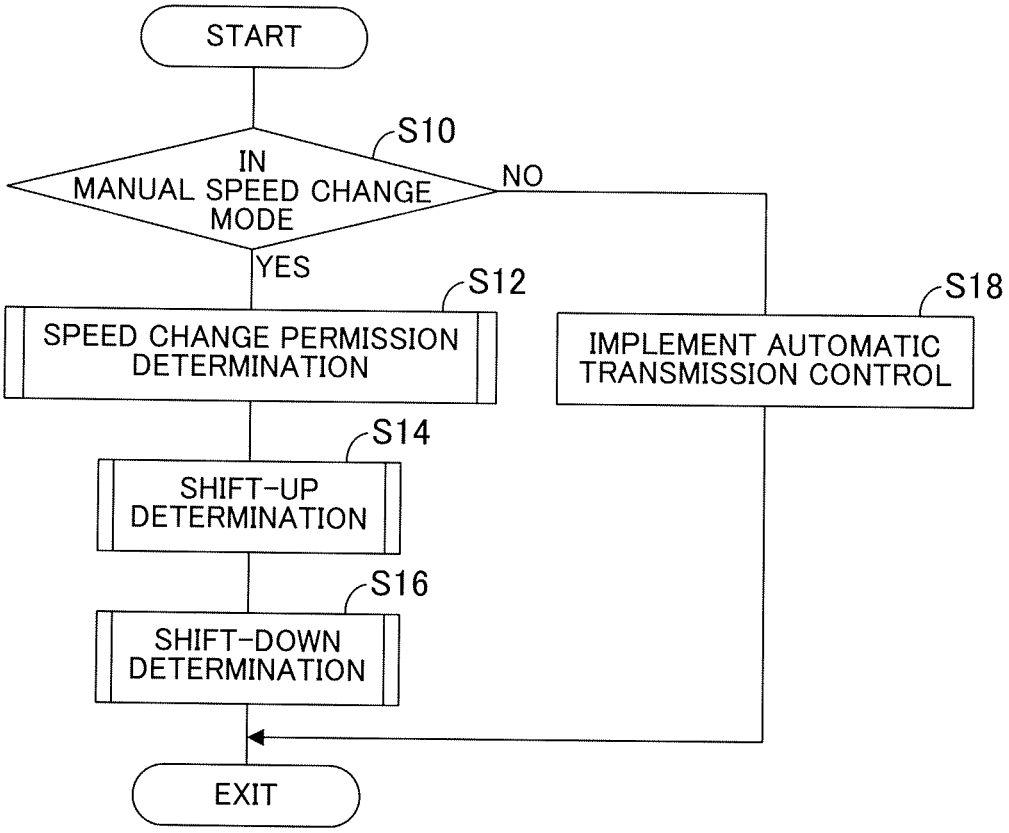
FIG. 6 is a flowchart showing transmission control operation by an electronic control unit shown in FIG. 1.

FIG. 6 is a flowchart showing the transmission control operation by the ECU 110. The illustrated program is executed by the ECU 110 at predetermined intervals, e.g., 100 milliseconds. Note that, although the transmission control between the first and second speeds is exemplified in the following for ease of understanding, the explanation is applicable to the transmission control between the second and third speeds or first and third speeds.

As shown in FIG. 6, the program begins at S10, in which it is determined based on the output of the change switch 126 whether the manual speed change mode is selected by the operator. When the result in S10 is affirmative, the program proceeds to S12, in which it is determined whether the gear position (speed) should be changed in response to the speed change command outputted from the shift switch 132.

Figure 7:
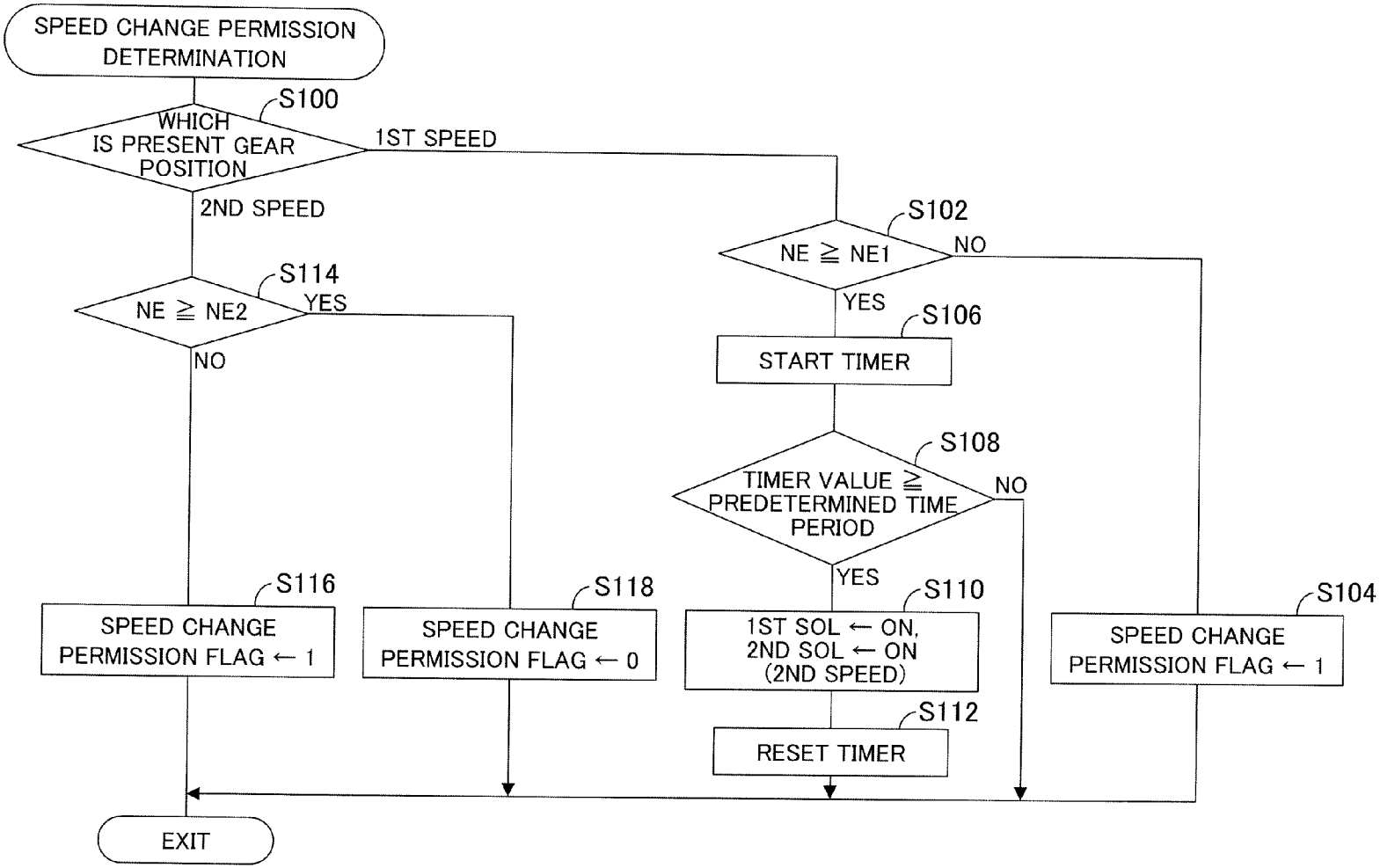
FIG. 7 is a subroutine flowchart showing the operation of speed change permission determination in the FIG. 6 flowchart.

FIG. 7 is a subroutine flowchart showing the operation of the speed change permission determination. First, in S100, the present gear position (speed) of the transmission 46 is determined. When the transmission 46 is determined to be in the first speed, the program proceeds to S102, in which it is determined whether the engine speed NE is equal to or greater than a first predetermined speed (predetermined speed) NE1. The first predetermined speed NE1 is set to a relatively high value (e.g., 6000 rpm) as a criterion for determining that, when the gear position is in the first speed and the engine 30 is operated at speed of the criterion value (i.e., 6000 rpm in this example), excessive load could likely act on the transmission gears (input primary gear 64, counter primary gear 66, etc.) of the transmission 46.

When the result in S102 is negative, it means that even when the transmission 46 is changed from the first speed to the second speed in response to the speed change command, the load on the transmission gears does not become excessive. Therefore, the program proceeds to S104, in which the bit of a manual speed change permission flag (hereinafter called the "speed change permission flag") is set to 1. The bit of this flag is set to 1 when the speed change to be conducted in response to the speed change command outputted from the shift switch 132 is permitted and reset to 0 when the speed change is not permitted, i.e., is prohibited.

When the result in S102 is affirmative, the program proceeds to S106, in which a timer (up counter) for measuring a time period that the engine 30 is operated at speed in a high-speed range of at or above the predetermined speed NE1, is started. In the case where, following the affirmative result in S102, the program proceeds to S106 in the next and subsequent loops, since the timer has been already started, a timer value is updated and the time measurement is continued.

Next the program proceeds to S108, in which it is determined whether the timer value is equal to or greater than a predetermined time period (e.g., 5 seconds), i.e., whether the engine speed NE is continuously equal to or greater than the first predetermined speed NE1 for the predetermined time period.

When the process of S108 is first conducted, since it is immediately after the timer is started in S106, the result is generally negative and the program is terminated. In contrast, when the result in S108 is affirmative, the program proceeds to S110, in which the operation of the transmission 46 is controlled to change the gear position from the first speed to the second speed, more exactly, the first and second solenoid valves 86*a*, 86*b* are both made ON to change the gear position (shift up the gear) from the first speed to the second speed. As a result, the engine speed NE is decreased and the transmission gear can avoid the excessive load accordingly. Then the program proceeds to S112, in which the timer is reset.

When the transmission 46 is determined to be in the second speed in S100, the program proceeds to S114, in which it is determined whether the engine speed NE is equal to or greater than a second predetermined speed NE2. The second predetermined speed NE2 is set to a relatively high value (e.g., 4500 rpm) as a criterion for determining that, when the gear position is changed from the second speed to the first speed at the time the engine 30 is operated at speed of the criterion value (i.e., 4500 rpm in this example), the excessive load could likely act on the transmission gears of the transmission 46, while the engine speed NE is increased and may result in overrevving of the engine 30. The second predetermined speed NE2 is set lower than the first predetermined speed NE1.

When the result in S114 is negative, it means that even when the transmission 46 is changed from the second speed to the first speed in response to the speed change command, the load on the transmission gears does not become excessive. Therefore, the program proceeds to S116, in which the bit of the speed change permission flag is set to 1. When the result in S114 is affirmative, the program proceeds to S118, in which the bit of the speed change permission flag is reset to 0.

Returning to the explanation on FIG. 6, the program proceeds to S14, in which it is determined whether the shift-up operation is conducted in response to the shift-up command outputted from the shift switch 132.

Figure 8:
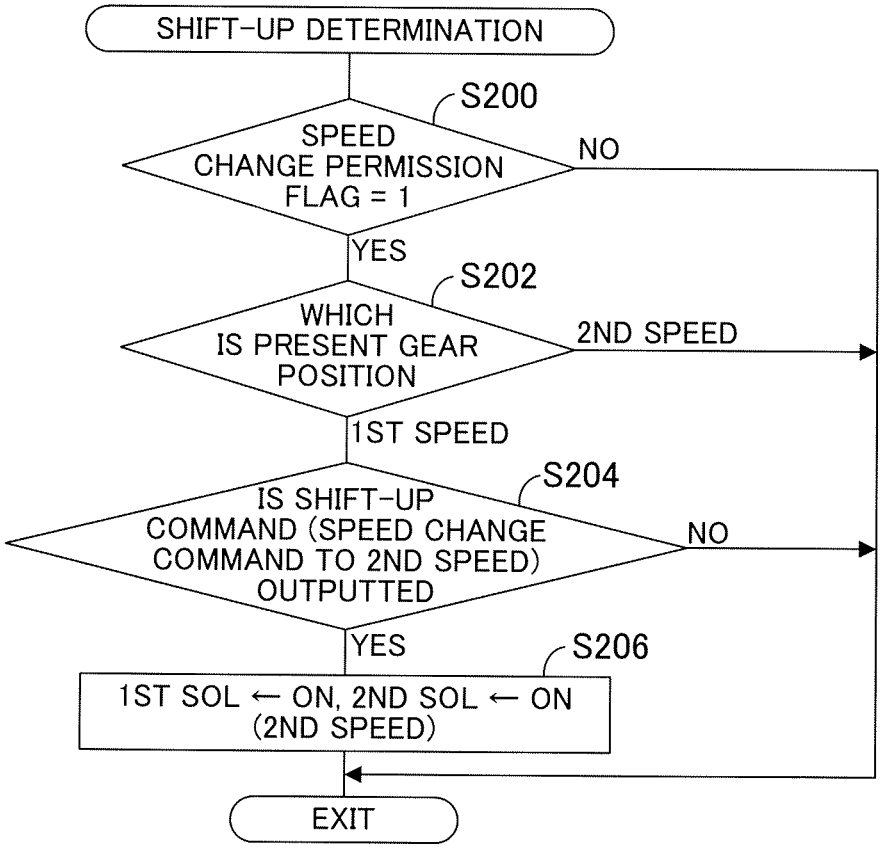
FIG. 8 is a subroutine flowchart showing the operation of shift-up determination in the FIG. 6 flowchart.

FIG. 8 is a subroutine flowchart showing the operation of the shift-up determination. First, in S200, it is determined whether the bit of the speed change permission flag is 1. When the result in S200 is affirmative, the program proceeds to S202, in which the present gear position of the transmission 46 is determined. When the transmission 46 is determined to be in the second speed, the remaining steps are skipped, while when determined to be in the first speed, the program proceeds to S204.

In S204, it is determined whether the shift-up command, precisely the speed change command to change the gear position from the first speed to the second speed is outputted from the shift switch 132. When the result in S204 is negative, the program is immediately terminated and when the result is affirmative, proceeds to S206, in which the first and second solenoid valves 86*a*, 86*b* are both made ON to change the gear position (shift up the gear) from the first speed to the second speed.

When the result in S200 is negative, the steps of S202 to S206 are skipped. In other words, in the case where the bit of the speed change permission flag is 0, even when the shift-up command is outputted from the shift switch 132, the transmission 46 is not shifted up (shift-up operation is prohibited).

Returning to the explanation on FIG. 6, the program proceeds to S16, in which it is determined whether the shift-down operation is conducted in response to the shift-down command outputted from the shift switch 132.

Figure 9:
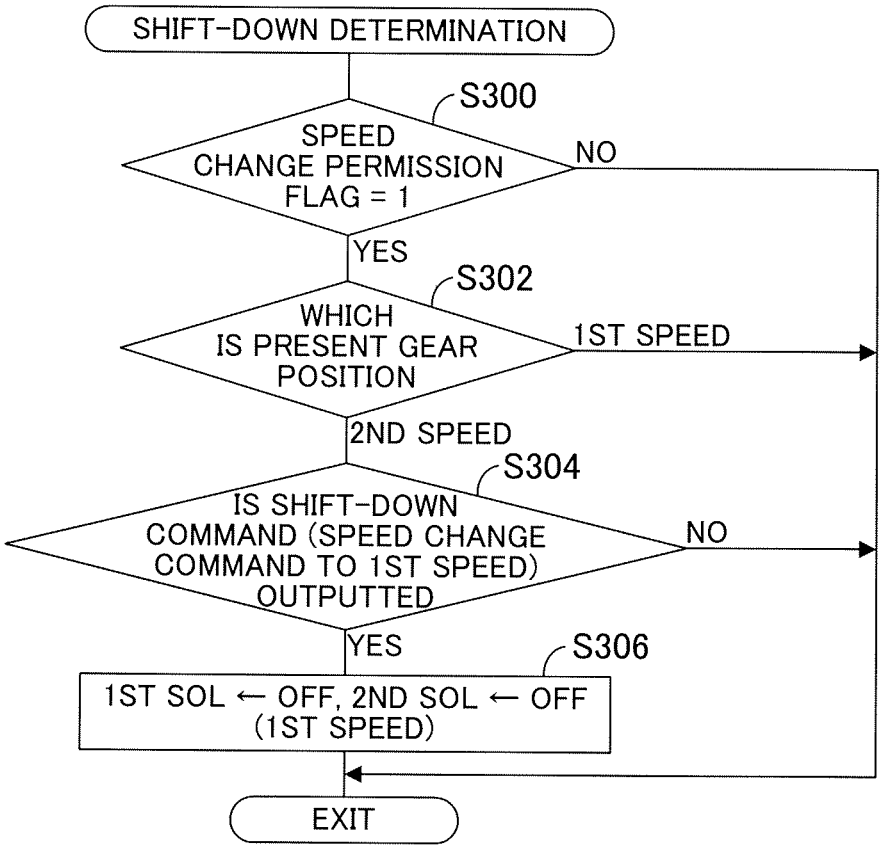
FIG. 9 is a subroutine flowchart showing the operation of shift-down determination in the FIG. 6 flowchart.

FIG. 9 is a subroutine flowchart showing the operation of the shift-down determination. First, in S300, it is determined whether the bit of the speed change permission flag is 1. When the result in S300 is affirmative, the program proceeds to S302, in which the present gear position of the transmission 46 is determined. When the transmission 46 is determined to be in the first speed in S302, the remaining steps are skipped, while when determined to be in the second speed, the program proceeds to S304, in which it is determined whether the shift-down command, precisely the speed change command to change the gear position from the second speed to the first speed is outputted from the shift switch 132.

When the result in S304 is negative, the program is immediately terminated and when the result is affirmative, proceeds to S306, in which the first and second solenoid valves 86*a*, 86*b* are both made OFF to change the gear position (shift down the gear) from the second speed to the first speed.

When the result in S300 is negative, the steps of S302 to S306 are skipped. In other words, in the case where the bit of the speed change permission flag is 0, even when the shift-down command is outputted from the shift switch 132, the transmission 46 is not shifted down (shift-down operation to the first speed is prohibited).

In the FIG. 6 flowchart, when the result in S10 is negative, i.e., when the automatic speed change mode is selected, the program proceeds to S18, in which automatic transmission control is implemented. The automatic transmission control is configured to determine the gear position (speed) to be established by retrieving mapped values stored in the ROM using the engine speed NE, throttle opening TH, lever 122 position, etc., and control the operation of the transmission 46 (i.e., transmission mechanism 50) so as to establish the determined gear position (speed). This will not be explained in detail here, since it is not directly related to the gist of this invention.

Figure 10:
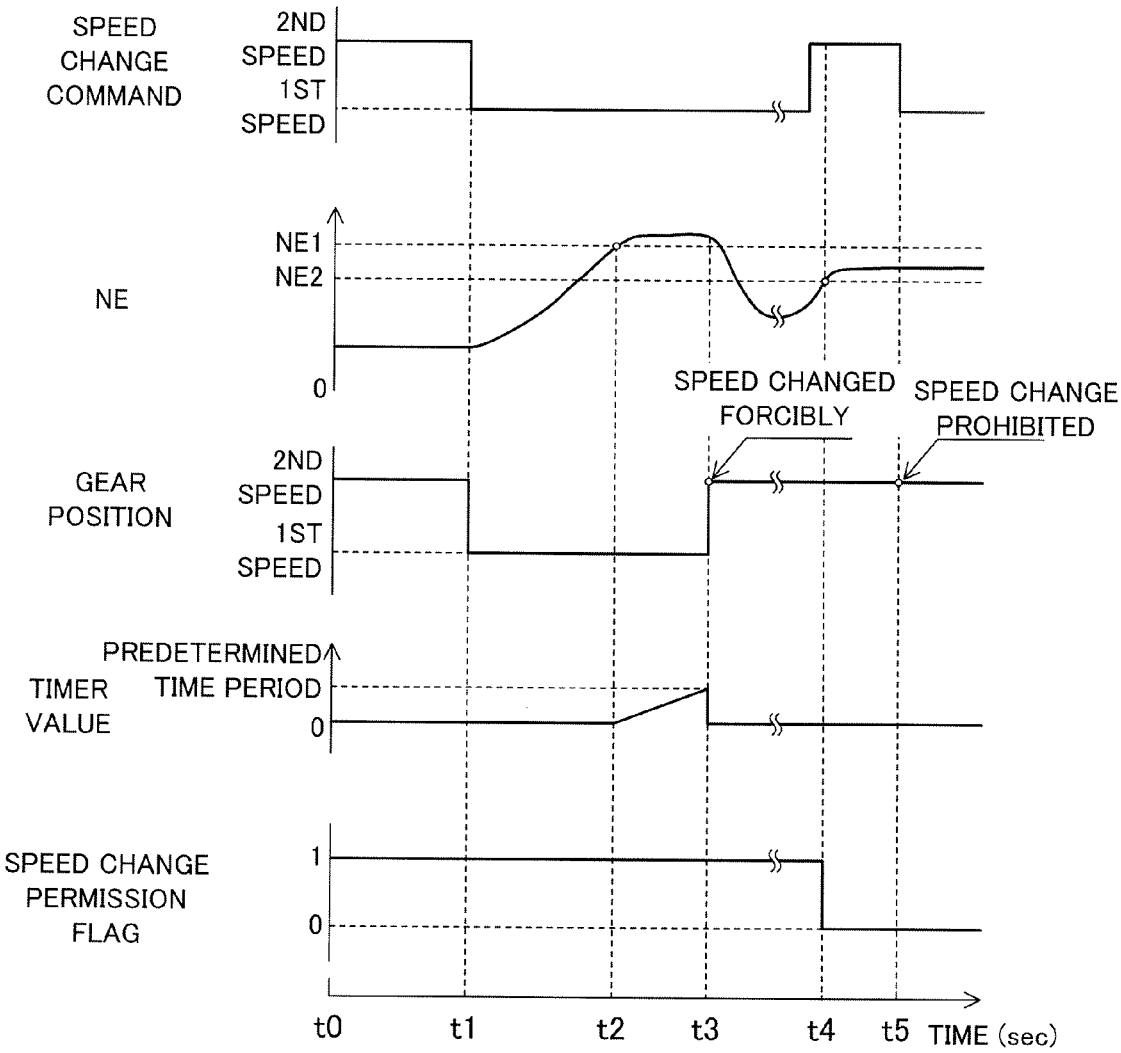
FIG. 10 is a time chart for explaining the operation of the flowcharts of FIGS. 6 to 9.

FIG. 10 is a time chart for explaining part of the above operation, specifically the transmission control in the manual speed change mode. In FIG. 10, there are indicated, in the order from the top, the speed change command of the shift switch 132, the engine speed NE, the present gear position of the transmission 46, the timer value and the bit of the speed change permission flag.

From the time t0 to t1, the transmission 46 is in the second speed and the engine speed NE is equal to or less than the second predetermined speed NE2. Accordingly, the bit of the speed change permission flag is set to 1 in S116. At the time t1, when the speed change command to change the gear position to the first speed is outputted from the shift switch 132 (S304), the transmission 46 is changed from the second speed to the first speed in response thereto (S306).

After that, the engine speed NE is gradually increased upon the manipulation of the lever 122 and when, at the time t1, it reaches the first predetermined speed NE1 so that the operation of the engine 30 enters the high-speed range, the timer is started (S106). When, at the time t3, the timer value becomes equal to or greater than the predetermined time period, in other words, when the engine speed NE is continuously equal to or greater than the first predetermined speed NE1 for the predetermined time period or more at the time the speed change command to change the gear position to the first speed is outputted (S108), the transmission 46 is forcibly changed from the first speed to the second speed (S110). As a result, the engine speed NE is decreased.

Further, as indicated with respect to the time t4, in the case where the transmission 46 is in the second speed and the engine speed NE is equal to or greater than the second predetermined speed NE2, the bit of the speed change permission flag is reset to 0 (S118). In such the operating condition of the engine 30, even when the speed change command to change the gear position to the first speed is outputted from the shift switch 132 at the time t5, the gear position is not changed to the first speed (negative result in S300). In other words, when the engine speed NE is equal to or greater than the second predetermined speed NE2, the speed change to the first speed is prohibited.

As stated above, the embodiment is configured to have an apparatus and a method for controlling operation of an outboard motor 10 to be mounted on a stern 12*a* of a boat 1 and having an internal combustion engine 30 to power a propeller 42 through a drive shaft (input shaft) 54 and a propeller shaft 44, and a transmission 46 that is installed at a location between the drive shaft 54 and the propeller shaft 44, the transmission being selectively changeable in gear position to establish speeds including at least a first gear speed and a second gear speed and transmitting power of the engine to the propeller with a gear ratio determined by established speed, comprising: shift switch 132 which outputs a gear change command (shift-up/down command), upon manipulation by an operator; and an electronic control unit 110, to control operation of the transmission 46 to change the gear position to the first speed gear or the second speed gear in response to the outputted gear change command, and which determines whether a speed NE of the engine is continuously equal to or greater than a predetermined speed (first predetermined speed) NE1 for a predetermined time period when the gear change command to the first speed gear is outputted, and the gear changes position from the first speed gear to the second speed gear when the speed NE of the engine is determined to be continuously equal to or greater than the predetermined speed NE1 for the predetermined time period.

Thus it is configured such that, when the engine speed NE is determined to be continuously equal to or greater than the first predetermined speed NE1 for the predetermined time period, the gear position is forcibly changed from the first speed to the second speed to decrease the engine speed NE. Consequently, it becomes possible to, for example, set the first predetermined speed NE1 to a relatively high value with which the load on the transmission gear may become excessive. Specifically, when the engine speed NE stays at or above such the value (NE1) continuously for the predetermined time period, the gear position is changed from the first speed to the second speed and hence, the engine 30 can avoid operating at high speed continuously for a long time (avoid overrevving which causes fluctuation in the engine speed). Therefore, it becomes possible to mitigate the load on the transmission gear, thereby improving durability of the transmission 46.

In the apparatus and method, the transmission controller prohibits change of the gear position to the first speed when the speed NE of the engine is equal to or greater than a second predetermined speed NE2 (S12, S16, S114, S118, S300).

With this, it becomes possible to, for example, set the second predetermined speed NE2 to a relatively high value with which, if the gear position is changed to the first speed, the load on the transmission gear may become excessive, while the engine speed NE is increased and may result in overrevving. As a result, since the gear position is not changed even when the speed change command to change the gear position from the second speed to the first speed is outputted under the condition where the time the engine 30 is operated at high speed, it becomes possible to prevent the excessive load from acting on the transmission gear, thereby further improving durability of the transmission 46.

In the apparatus and method, the predetermined speed NE1 is set as a criterion for determining that excessive load could likely act on transmission gears (input primary gear 64, counter primary gear 66, etc.) of the transmission 46 when the gear position is in the first speed and the engine 30 is operated at the predetermined speed NE1.

In the apparatus and method, the second predetermined speed NE2 is set lower than the first predetermined speed NE1.

It should be noted that, although the outboard motor is exemplified above, this invention can be applied to an inboard/outboard motor equipped with a transmission.

It should also be noted that, although the first and second predetermined speeds NE1, NE2, displacement of the engine 30 and other values are indicated with specific values in the foregoing, they are only examples and not limited thereto.

Japanese Patent Application No. 2010-123289, filed on May 28, 2010 is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor having an internal combustion engine to power a propeller through a drive shaft and a propeller shaft, and a transmission that is installed at a location between the drive shaft and the propeller shaft, the transmission being selectively changeable in gear position to establish at least a first gear speed and a second gear speed and transmitting power of the engine to the propeller with a gear ratio determined by established gear speed, comprising:

a shift switch that is located on a throttle control lever and outputs a gear change command upon manipulation by an operator; and an electronic control unit which controls the transmission, and that determines, based on sensor output from a crank angle sensor, whether a speed of the engine is continuously equal to or greater than a predetermined speed for a predetermined time period when the outputted gear change command to change to the first speed gear is outputted, and the wherein the transmission changes the gear position from the first speed gear to the second speed gear when the speed of the engine is determined to be continuously equal to or greater than the predetermined speed for the predetermined time period.

2. The apparatus according to claim 1, wherein the electronic control unit controls the transmission to prohibit change of the gear position to the first speed gear when the speed of the engine is equal to or greater than a second predetermined speed.

3. The apparatus according to claim 1, wherein the predetermined speed is set as a criterion for determining an excessive load that could likely act on transmission gears of the transmission when the gear position is in the first speed gear and the engine is operated at the predetermined speed.

4. The apparatus according to claim 2, wherein the second predetermined speed is set lower than the predetermined speed.

5. A method for controlling operation of an outboard motor for a boat and having an internal combustion engine to power a propeller through a drive shaft and a propeller shaft, and a transmission that is installed at a location between the drive shaft and the propeller shaft, the transmission being selectively changeable in gear position to establish at least a first gear speed and a second gear speed and transmitting power of the engine to the propeller with a gear ratio determined by established speed, comprising the steps of:

outputting a gear change command upon manipulation by an operator of a shift switch which sends an output to an electronic control unit;

changing the gear position to the first speed gear or the second speed gear in response to the outputted gear change command from the electronic control unit to the transmission; and determining whether a speed of the engine is continuously equal to or greater than a predetermined speed based on output of the crank angle sensor to the electronic control unit, for a predetermined time period when the gear change command to the first speed gear is outputted, wherein the step of changing, changes the gear position from the first speed gear to the second speed gear when the speed of the engine is determined to be continuously equal to or greater than the predetermined speed for the predetermined time period.

6. The method according to claim 5, wherein the step of changing prohibits change of the gear position to the first speed gear when the speed of the engine is equal to or greater than a second predetermined speed.

7. The method according to claim 5, wherein the predetermined speed is set as a criterion for determining an excessive load that could likely act on transmission gears of the transmission when the gear position is in the first speed gear and the engine is operated at the predetermined speed.

8. The method according to claim 6, wherein the second predetermined speed is set lower than the predetermined speed.

* * * * *